US010537778B2

(12) United States Patent
Mayer, II et al.

(10) Patent No.: US 10,537,778 B2
(45) Date of Patent: Jan. 21, 2020

(54) HOCKEY PUCKS WITH ENHANCED ABILITY TO SLIDE ON ICE AND NON-ICE SURFACES

(71) Applicant: Smarthockey, Inc., Austin, TX (US)

(72) Inventors: Bruce Allen Mayer, II, Austin, TX (US); Brad Thomas Mayer, Austin, TX (US)

(73) Assignee: SMARTHOCKEY, INC., Austin, TX (US)

( * ) Notice: Subject to any disclaimer, the term of this patent is extended or adjusted under 35 U.S.C. 154(b) by 0 days.

(21) Appl. No.: 14/714,886

(22) Filed: May 18, 2015

(65) Prior Publication Data

US 2015/0375076 A1 Dec. 31, 2015

Related U.S. Application Data

(60) Provisional application No. 62/002,171, filed on May 22, 2014.

(51) Int. Cl.
*A63B 67/14* (2006.01)

(52) U.S. Cl.
CPC ..... *A63B 67/14* (2013.01)

(58) Field of Classification Search
CPC ..... A63B 67/14
USPC ..... 473/588, 446
See application file for complete search history.

(56) References Cited

U.S. PATENT DOCUMENTS 3,797,057 A * 3/1974 Smelden ..... A63B 67/14 473/588
3,887,188 A * 6/1975 Beauchamp ..... A63B 67/14 473/446
3,997,164 A * 12/1976 White, Sr. ..... A63B 67/14 473/588
4,078,801 A * 3/1978 White, Sr. ..... A63B 67/14 473/588
5,014,990 A * 5/1991 Kaser ..... A63B 67/14 446/46
5,207,720 A * 5/1993 Shepherd ..... A63B 67/14 473/446
5,269,520 A * 12/1993 Vellines ..... A63B 67/14 473/588
5,284,343 A * 2/1994 Bigornia ..... A63B 21/0603 473/446

(Continued)

*Primary Examiner* — Eugene L Kim
*Assistant Examiner* — Christopher Glenn
(74) *Attorney, Agent, or Firm* — Norton Rose Fulbright US LLP

(57) ABSTRACT

This disclosure includes hockey pucks and methods of making hockey pucks. Some pucks include a shell having an upper shell member and a lower shell member coupled to the upper shell member to define a cavity and a ballast member disposed in the cavity such that at least a portion of the ballast member is translatable relative to the shell. Some pucks include a resilient material disposed in the cavity and configured to resist translation of the ballast member in at least one direction relative to the shell. Some pucks include a cylindrical outer housing surrounding the shell. Some pucks include first and third substantially cylindrical members, a second member, a first plurality of fasteners to couple the first member to the second member independently of the third member, and a second plurality of fasteners to couple the third member to the second member independently of the first member.

20 Claims, 9 Drawing Sheets

(56) References Cited

U.S. PATENT DOCUMENTS

| | | | | | |
|---|---|---|---|---|---|
| 5,421,588 | A * | 6/1995 | Browne | A63B 67/06 | 473/588 |
| 5,443,106 | A * | 8/1995 | Browne | A63B 67/06 | 156/182 |
| 5,465,966 | A * | 11/1995 | La Savio | A63B 67/14 | 473/588 |
| 5,472,193 | A * | 12/1995 | Everman | A63B 67/14 | 473/570 |
| 5,518,237 | A | 5/1996 | Bellehumeur | 473/588 | |
| 5,676,376 | A * | 10/1997 | Valley | A44C 21/00 | 273/148 R |
| 5,792,012 | A | 8/1998 | Dudley | 473/588 | |
| 5,976,042 | A * | 11/1999 | LaMarche | A63B 67/14 | 473/588 |
| 6,217,468 | B1 * | 4/2001 | Goodwin | A63B 67/14 | 473/588 |
| 6,908,359 | B2 * | 6/2005 | Orlowski | A63H 33/18 | 446/46 |
| 7,867,112 | B1 * | 1/2011 | Giauque | A63B 69/0026 | 473/422 |
| 2003/0119613 | A1 * | 6/2003 | Samuel | A63B 43/00 | 473/588 |
| 2005/0192130 | A1 * | 9/2005 | Edwards | A63B 67/14 | 473/588 |
| 2006/0196602 | A1 * | 9/2006 | Poruchny | A63B 67/14 | 156/307.3 |
| 2008/0176684 | A1 * | 7/2008 | Edwards | A63B 67/14 | 473/588 |

* cited by examiner

HOCKEY PUCKS WITH ENHANCED ABILITY TO SLIDE ON ICE AND NON-ICE SURFACES

CROSS-REFERENCE TO RELATED APPLICATIONS

This application claims priority to U.S. Provisional Application No. 62/002,171 filed May 22, 2014, which is incorporated herein by reference in its entirety.

BACKGROUND

1. Field of Invention

This disclosure relates generally to hockey, and more specifically, but not by way of limitation, to hockey pucks with enhanced ability to slide (rather than tumble) on ice and non-ice surfaces, such as, for example, ice, roadways, sidewalks, cement, wood, and/or the like, methods for making the same, and to games played therewith.

2. Description of Related Art

A typical ice hockey puck has the geometry of a circular disk, with a thickness of about one inch and a diameter of about three inches. Such pucks are typically made of a hard rubber. When used on ice, due in part to the low coefficient of friction between the puck and the ice, these pucks have the tendency to smoothly slide across the ice on one of the disk faces.

Hockey is also played on hard non-ice surfaces, such as streets and roadways (e.g., paved with asphalt, concrete, or cement), wooden surfaces, and/or the like, which is sometimes referred to as street hockey. When a conventional hockey puck is used on such a surface, the relatively high coefficient of friction between the surface and the puck (e.g., greater than that of ice) tends to undesirably slow the speed of the puck, and/or force the puck onto its edge where it may begin to roll. As such, it is typically desirable to use a different puck for playing street hockey than for playing ice hockey.

Examples of hockey pucks are disclosed in U.S. Pat. Nos. 5,792,012, 5,518,237, 4,078,801, and 5,284,343.

SUMMARY

Some of the present pucks are configured, through a moveable ballast member disposed in a cavity of a shell, to absorb impacts and resist tumbling, bouncing, and/or rolling when struck and/or when sliding across an ice or non-ice surface. Some pucks are configured, through a resilient material disposed in the cavity and configured to dampen movements of the moveable ballast member, to absorb impacts and resist tumbling, bouncing, and/or rolling when struck and/or when sliding across an ice or non-ice surface.

Some of the present pucks are configured, through a first cylindrical member and a third cylindrical member, each resiliently coupled within a recess on opposite sides of a second member, to provide for both enhanced stability and predictable puck behavior (e.g., by comprising a uniform, and in some cases, substantially rigid, puck striking surface with energy absorbing structures disposed within). Some pucks are configured, through independent and resilient coupling of a first member to a second member and a third member to a second member, to simulate the behavior of a traditional ice hockey puck on ice (e.g., by increasing stability of the puck through at least the absorption of energy by the resilient material).

Some embodiments of the present hockey pucks for use on ice and non-ice surfaces comprise: a shell comprising an upper shell member and a lower shell member coupled to the upper shell member to define a cavity surrounding a central shaft; a ballast member disposed in the cavity and around the central shaft such that the central shaft extends through the ballast member and at least a portion of the ballast member is translatable relative to the shell; and a resilient material disposed in the cavity and configured to resist translation of the ballast member in at least one direction relative to the shell. In some embodiments, at least a portion of the resilient material is in direct contact with the central shaft. In some embodiments, at least one dimension of the ballast member spans a majority of a corresponding dimension of the cavity. In some embodiments, the resilient material is disposed around the central shaft such that the central shaft extends through the resilient material. In some embodiments, at least one of the resilient material and the ballast member is shaped as a washer. Some embodiments further comprise: a cylindrical outer housing surrounding the shell, the outer housing having a substantially circular cross-section. In some embodiments, the central shaft defines an interior channel and a portion of the outer housing is disposed within the interior channel.

Some embodiments of the present hockey pucks for use on ice and non-ice surfaces comprise: a shell comprising an upper shell member and a lower shell member coupled to the upper shell member to define a cavity; a ballast member disposed in the cavity such that at least a portion of the ballast member is translatable relative to the shell, at least one dimension of the ballast member spanning a majority of a corresponding dimension of the cavity; and a resilient material disposed in the cavity and configured to resist translation of the ballast member in at least one direction relative to the shell.

Some embodiments of the present hockey pucks for use on ice and non-ice surfaces comprise: a shell comprising an upper shell member and a lower shell member coupled to the upper shell member to define a cavity; a ballast member disposed in the cavity such that at least a portion of the ballast member is translatable relative to the shell; and a single-piece, cylindrical outer housing substantially surrounding the shell, the outer housing having a substantially circular cross-section. Some embodiments further comprise a resilient material disposed in the cavity and configured to resist translation of the ballast member in at least one direction relative to the shell.

In some embodiments of the present hockey pucks, the upper shell member is not coupled to the lower shell member by a fastener. In some embodiments, the upper shell member is coupled in fixed relation to the lower shell member. In some embodiments, the upper shell member is unitary with the lower shell member. In some embodiments, the ballast member has a weight that is between 40% and 60% of a weight of the overall puck. In some embodiments, the ballast member comprises a plate. In some embodiments, the ballast member comprises stainless steel. In some embodiments, the resilient material is disposed on at least two sides of the ballast member. In some embodiments, the resilient material comprises one or more plates. In some embodiments, the resilient material comprises foam.

In some embodiments of the present hockey pucks, the hockey puck has a weight of between 4.5 ounces (oz.) and 6 oz. In some embodiments, the ballast member has a weight of between 40% and 60% of the weight of the hockey puck. In some embodiments of the present hockey pucks, the hockey puck has a weight of between 2.5 ounces (oz.) and 4 oz. In some embodiments, the ballast member has a weight of between 15% and 25% of the weight of the hockey puck. In some embodiments of the present hockey pucks, the hockey puck has a weight of between 8 ounces (oz.) and 10 oz. In some embodiments, the ballast member has a weight of between 60% and 80% of the weight of the hockey puck.

Some embodiments of the present methods (e.g., for assembling a hockey puck for use on ice and non-ice surfaces) comprise: disposing a ballast member in a cavity of a shell such that at least a portion of the ballast member is translatable relative to the shell and at least one dimension of the ballast member spans a majority of a corresponding dimension of the cavity; and disposing a resilient material in the cavity such that the resilient material resists translation of the ballast member in at least one direction relative to the shell. Some embodiments further comprise: disposing a single-piece, cylindrical outer housing around the shell such that the outer housing substantially surrounds the shell. In some embodiments, the outer housing is molded around the shell.

Some embodiments of the present methods (for assembling a hockey puck) comprise: disposing a ballast member in a cavity of a shell such that at least a portion of the ballast member is translatable relative to the shell; and disposing a single-piece, cylindrical outer housing around the shell such that the outer housing substantially surrounds the shell. In some embodiments, the outer housing is molded around the shell. Some embodiments further comprise: disposing a resilient material in the cavity such that the resilient material resists translation of the ballast member in at least one direction relative to the shell.

Some embodiments of the present hockey pucks for use on ice and non-ice surfaces comprise: a first member that is substantially cylindrical and has a first diameter; a second member having a first end, a second end, and at least one transverse dimension that is larger than the first diameter; a third member that is substantially cylindrical and has a third diameter; a first plurality of fasteners configured to couple the first member to the first end of the second member independently of the third member such that the first member is movable within a limited range of motion relative to the second member; and a second plurality of fasteners configured to couple the third member to the second end of the second member independently of the first member such that the third member is movable within a limited range of motion relative to the second member. In some embodiments, the first end of the second member defines a first recess configured to receive at least a portion of the first member. In some embodiments, the first recess has a transverse dimension that is larger than the first diameter to permit lateral movement of the first member within the first recess. In some embodiments, the second end of the second member defines a second recess configured to receive at least a portion of the third member. In some embodiments, the second recess has a transverse dimension that is larger than the third diameter to permit lateral movement of the third member within the second recess. In some embodiments, an outer end of the first member defines a first substantially annular recess, and/or an outer end of the third member defines a second substantially annular recess.

In some embodiments of the present hockey pucks, the first member defines a first plurality of (e.g., three) holes, each configured to receive one of the first plurality of fasteners. In some embodiments, the first plurality of holes are disposed at equiangular spaces around a central axis of the first member. In some embodiments, the first plurality of holes is defined within the first substantially annular recess. In some embodiments, at least some of the first plurality of holes are counterbored. In some embodiments, the third member defines a second plurality of (e.g., three) holes, each configured to receive one of the second plurality of fasteners. In some embodiments, the second plurality of holes are disposed at equiangular spaces around a central axis of the third member. In some embodiments, the second plurality of holes is defined within the second substantially annular recess. In some embodiments, at least some of the second plurality of holes are counterbored.

Some embodiments of the present hockey pucks further comprise: a resilient material configured to be disposed between the first member and the second member. In some embodiments, the resilient material comprises a plurality of washers, each configured to be disposed around one of the first plurality of fasteners. Some embodiments further comprise: a resilient material configured to be disposed between the third member and the second member. In some embodiments, the resilient material comprises a plurality of washers, each configured to be disposed around one of the second plurality of fasteners. In some embodiments, the resilient material comprises at least one of rubber and foam. In some embodiments, the first plurality of fasteners is unitary with at least one of the first member or the second member and/or the second plurality of fasteners is unitary with at least one of the third member or the second member. In some embodiments, the third diameter is substantially equal to the first diameter.

Some embodiments of the present methods (for assembling a hockey puck for use on ice and non-ice surfaces) comprise: coupling, with a first plurality of fasteners, a first member to a first end of a second member such that the first member is movable within a limited range of motion relative to the second member, the first member being substantially cylindrical and having a first diameter, the second member having at least one transverse dimension that is larger than the first diameter; and coupling, with a second plurality of fasteners, a third member to a second end of the second member such that the third member is movable within a limited range of motion relative to the second member, the third member being substantially cylindrical and having a third diameter. Some embodiments further comprise: disposing resilient material between the first member and the third member. Some embodiments further comprise: disposing resilient material between the second member and the third member.

The term "coupled" is defined as connected, although not necessarily directly, and not necessarily mechanically; two items that are "coupled" may be unitary with each other. The terms "a" and "an" are defined as one or more unless this disclosure explicitly requires otherwise. The term "substantially" is defined as largely but not necessarily wholly what is specified (and includes what is specified; e.g., substantially 90 degrees includes 90 degrees and substantially parallel includes parallel), as understood by a person of ordinary skill in the art. In any disclosed embodiment, the terms "substantially," "approximately," and "about" may be substituted with "within [a percentage] of" what is specified, where the percentage includes 0.1, 1, 5, 10, and 20 percent.

Further, a device or system that is configured in a certain way is configured in at least that way, but it can also be configured in other ways than those specifically described.

The terms "comprise" (and any form of comprise, such as "comprises" and "comprising"), "have" (and any form of have, such as "has" and "having"), "include" (and any form of include, such as "includes" and "including"), and "contain" (and any form of contain, such as "contains" and "containing") are open-ended linking verbs. As a result, an apparatus that "comprises," "has," "includes," or "contains" one or more elements possesses those one or more elements, but is not limited to possessing only those elements. Likewise, a method that "comprises," "has," "includes," or "contains" one or more steps possesses those one or more steps, but is not limited to possessing only those one or more steps.

Any embodiment of any of the apparatuses, systems, and methods can consist of or consist essentially of—rather than comprise/include/contain/have—any of the described steps, elements, and/or features. Thus, in any of the claims, the term "consisting of" or "consisting essentially of" can be substituted for any of the open-ended linking verbs recited above, in order to change the scope of a given claim from what it would otherwise be using the open-ended linking verb.

The feature or features of one embodiment may be applied to other embodiments, even though not described or illustrated, unless expressly prohibited by this disclosure or the nature of the embodiments.

Some details associated with the embodiments described above and others are described below.

BRIEF DESCRIPTION OF THE DRAWINGS

The following drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

DETAILED DESCRIPTION OF ILLUSTRATIVE EMBODIMENTS

Figure 1A:
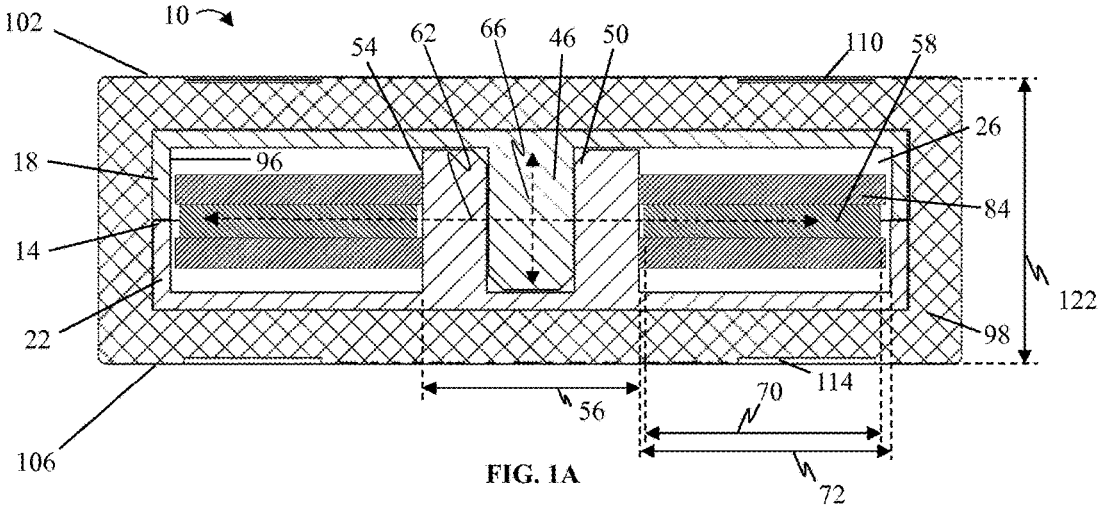
FIG. 1A is a cross-sectional side view of a first embodiment of the present pucks.
Figure 1B:
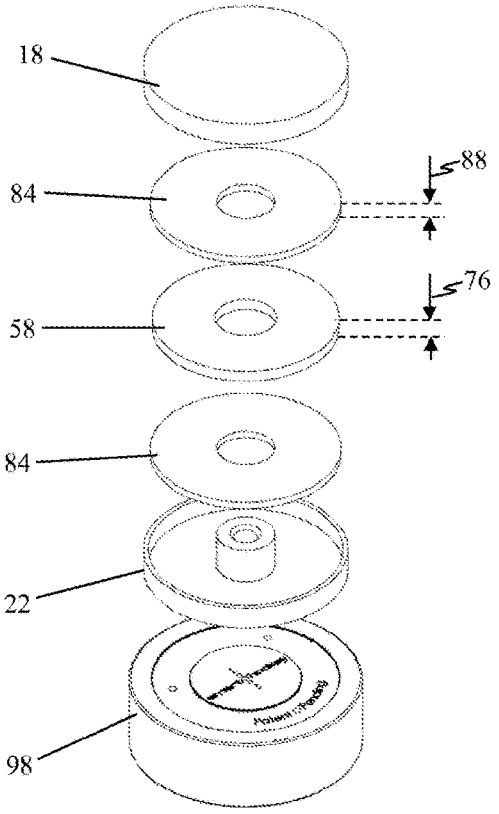
FIG. 1B is an exploded perspective view of the puck of FIG. 1A.
Figure 1C:
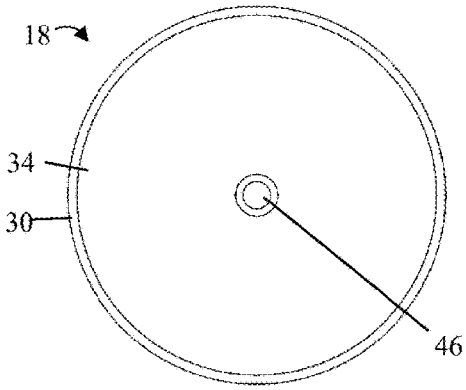
FIGS. 1C and 1D are bottom and cross-sectional side views, respectively, of the upper shell member of the puck of FIG. 1A.
Figure 1E:
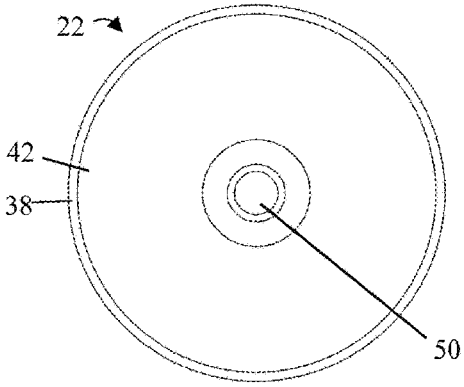
FIGS. 1E and 1F are top and cross-sectional side views, respectively, of the lower shell member of the puck of FIG. 1A.
Figure 1D:
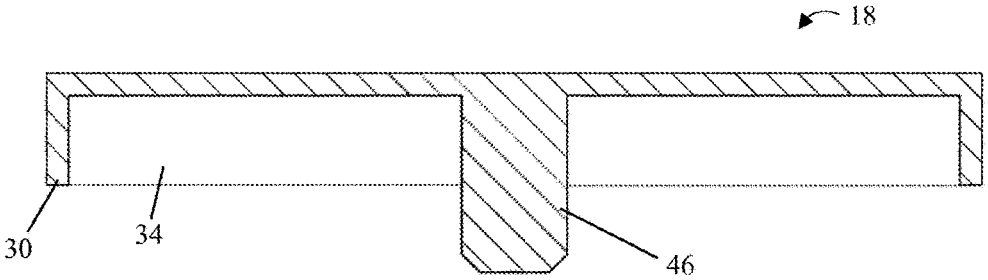
Figure 1F:
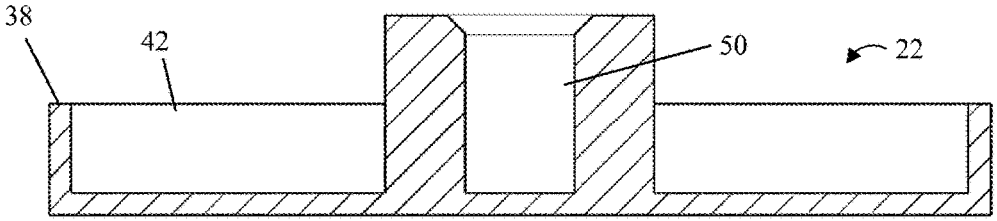
Figure 1G:
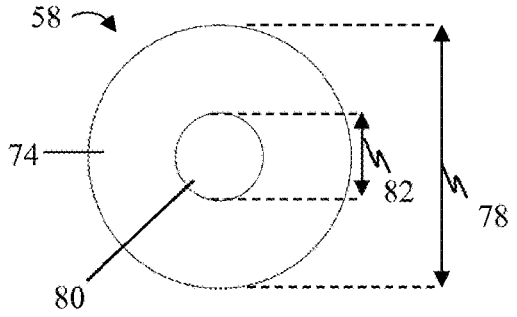
FIG. 1G is a top view of a ballast member of the puck of FIG. 1A.
Figure 1H:
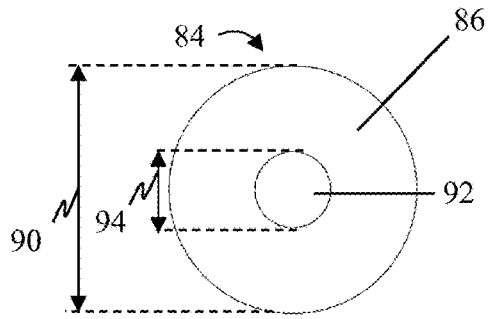
FIG. 1H is a top view of a resilient material of the puck of FIG. 1A.

Referring now to the drawings, and more particularly to FIGS. 1A-1I, shown therein and designated by the reference numeral 10 is a first embodiment of the present pucks. Puck 10 comprises a shell 14 having an upper shell member 18 and a lower shell member 22 coupled to the upper shell member to define a cavity 26. For example, in the embodiment shown, the lower end 30 of upper shell member 18 defines a first annular recess 34, and the upper end 38 of lower shell member 22 defines a second annular recess 42 such that when the upper shell member is coupled to the lower shell member, first and second recesses 34 and 42 cooperate to define annular cavity 26, as shown. In the embodiment shown, upper shell member 18 is coupled to lower shell member 22 without any fasteners (e.g., screws, rivets, nuts and bolts, and/or the like). For example, in this embodiment, upper shell member 18 includes a protrusion 46 that is configured to be received within (e.g., pressed into) a receptacle 50 of lower shell member 22 (e.g., such that the lower shell member is coupled to the upper shell member by way of a press-fit). In this embodiment, puck 10 comprises a central shaft 54 that is surrounded by annular cavity 26. For example, in this embodiment, protrusion 46 and/or receptacle 50 define at least a portion of central shaft 54 (e.g., as shown). As described in more detail below, central shaft 54 can be configured to locate various components of the present pucks (e.g., a ballast member and/or resilient materials, as described below) and/or provide structural support for shell 14. In other embodiments, upper shell member 18 can be coupled to lower shell member 22 by or with any suitable alternative or additional structure, such as, for example, adhesive, interlocking features of upper shell member 18 and/or lower shell member 22, and/or the like. In some embodiments, upper shell member 18 may be unitary with lower shell member 22 to form a single-piece shell member 14 (e.g., upper shell member 18 may be hinged relative to lower shell member 22 by a unitary or "living" hinge). In the embodiment shown, upper shell member 18 is coupled in fixed relation to lower shell member 22.

In the embodiment shown, puck 10 comprises a ballast member 58 disposed in cavity 26 such that at least a portion of the ballast member is translatable relative to shell 14 (e.g., movable along a direction indicated by arrows 62, 66, and/or the like). In the embodiment shown, ballast member 58 is shaped like a washer and is disposed around central shaft 54 such that the central shaft extends through the ballast member. In this way, central shaft 54 can be configured to locate and/or secure the ballast member within shell 14 and/or limit allowable translation of the ballast member relative to the shell (described in more detail below).

In the embodiment shown, at least one dimension (e.g., 70) of ballast member 58 spans a majority of a corresponding dimension (e.g., 72) measured along a substantially similar direction of cavity 26. That dimension 70 spans a majority of dimension 72 can further locate the ballast member and/or limit allowable translation of the ballast member relative to the shell (described in more detail below). In the embodiment shown, ballast member 58 comprises a washer-shaped plate 74 (e.g., is substantially planar, having a thickness 76 and a transverse dimension 78 substantially larger than the thickness). In this embodiment, ballast member 58 comprises a hole 80 with a transverse dimension 82 (e.g., such that ballast member 58 comprises and/or is shaped like a washer). In the embodiment shown, ballast member 58 can be disposed around central shaft 54 (e.g., as shown in FIG. 1A). For example, transverse dimension 82 of hole 80 can be larger than or substantially equal to a transverse dimension 56 of central shaft 54. In this embodiment, transverse dimension 82 of hole 80 is larger than transverse dimension 56 of central shaft 54, for example, to limit allowable translation of the ballast member relative to the central shaft.

In the embodiment shown, ballast member 58 has a weight that is between 40% and 60% (e.g., 50%) of a weight of the overall puck. In this embodiment, ballast member 58 comprises stainless steel; however, in other embodiments, ballast member 58 can comprise any suitable material, such as, for example, other metals (e.g., iron, aluminum, alloys), composites, resilient materials (e.g., natural rubber, synthetic rubber), and/or the like.

In the embodiment shown, puck 10 comprises a resilient material 84 disposed in cavity 26 and configured to resist translation of ballast member 58 in at least one direction (e.g., indicated by arrows 62, 66, and/or the like) relative to shell 14. In this embodiment, resilient material 84 comprises one or more (e.g., two, as shown) washer-shaped plates 86 each having a thickness 88 and a transverse dimension 90 substantially larger than the thickness). For example, resilient material 84 can be disposed on at least two sides of ballast member 58, as shown. In the embodiment shown, resilient material 84 comprises a hole 92 having a transverse dimension 94 (e.g., such that resilient material 84 comprises and/or is shaped like a washer). In this embodiment, resilient material 84 is disposed around central shaft 54 such that the central shaft extends through the resilient material (e.g., through hole 92). In some embodiments (e.g., 10) at least a portion of resilient material 84 is in direct contact with central shaft 54. For example, in this embodiment, transverse dimension 94 of hole 92 is substantially equal to transverse dimension 56 of central shaft 54. In this way, resilient material 84 can be secured within shell 14, for example, to locate ballast member 58 within shell 14 when the ballast member is disposed between and/or within the resilient material. In the embodiment shown, resilient material 84 comprises foam; however, in other embodiments, the present pucks can comprise any alternative or additional resilient material, such as, for example, rubber, resilient polymer, spring, woven or matted material, and/or the like that is/are configured to absorb energy when deflected.

Embodiments of the present disclosure can have any suitable configuration of ballast member(s) (e.g., 58), resilient materials (e.g., 84), and/or cavity (e.g., 26) that enables the functionality described in this disclosure. For example, in the embodiment shown, ballast member 58 and resilient material 84 are disposed around central shaft 54 such that the ballast member is translatable relative to the central shaft (e.g., transverse dimension 82 of hole 80 is larger than transverse dimension 56 of central shaft 54) and the resilient material is in direct contact with both the central shaft (e.g., transverse dimension 94 of hole 92 is substantially equal to transverse dimension 56 of central shaft 54) and the ballast member (e.g., resilient material 84 is disposed in direct contact with at least two sides of ballast member 58). In this way, when puck 10 is impacted (e.g., is struck, hits an object, catches on a feature of a rough surface, and/or the like), ballast member 58 can translate relative to shell 14 (e.g., and be limited in maximum translation by transverse dimension 56 of central shaft or a sidewall 96 of cavity 26). In this way, resilient material 84 can absorb energy associated with translation of ballast member 58 (and thus the impact of the puck) by deforming and/or exerting a frictional force on the ballast member.

Figure 1I:
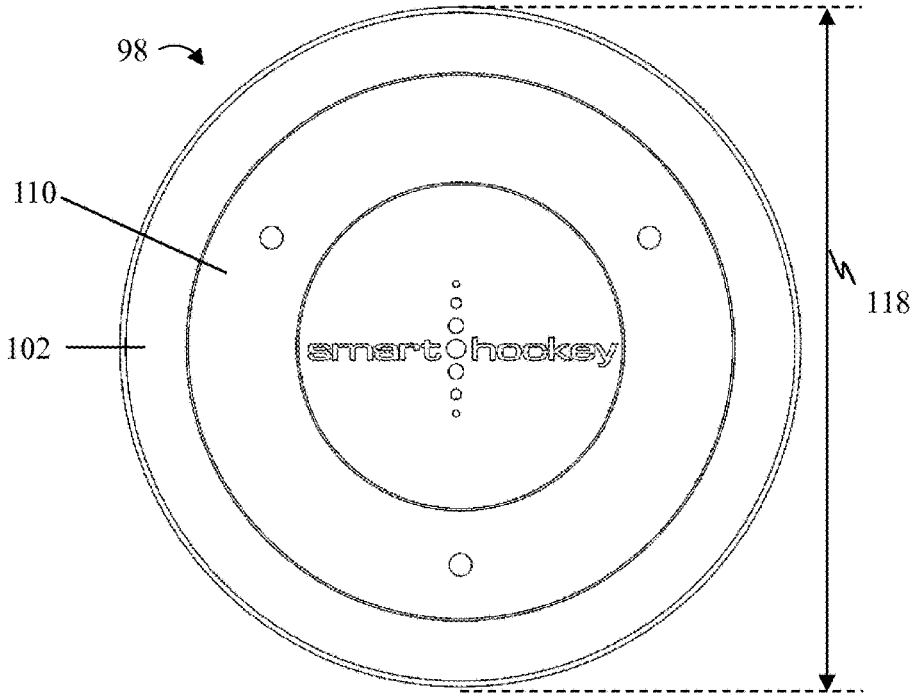
FIG. 1I is a top view of the puck of FIG. 1A.
Figure 2A:
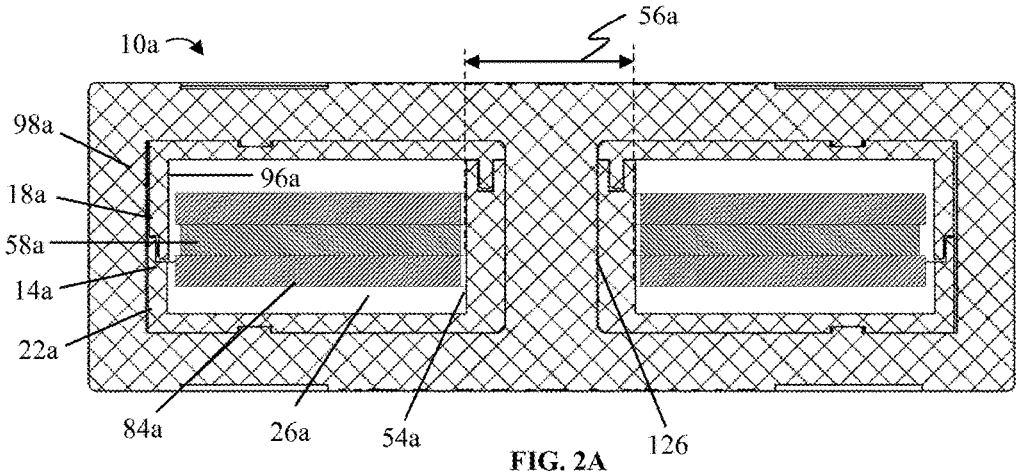
FIG. 2A is a cross-sectional side view of a second embodiment of the present pucks.
Figure 2B:
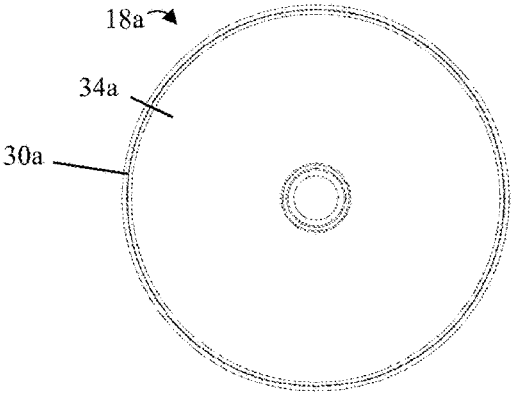
FIGS. 2B and 2C are bottom and cross-sectional side views, respectively, of the upper shell member of the puck of FIG. 2A.
Figure 2D:
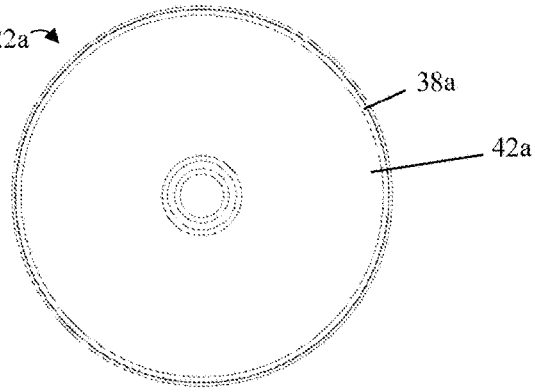
FIGS. 2D and 2E are top and cross-sectional side views, respectively, of the lower shell member of the puck of FIG. 2A.
Figure 2C:
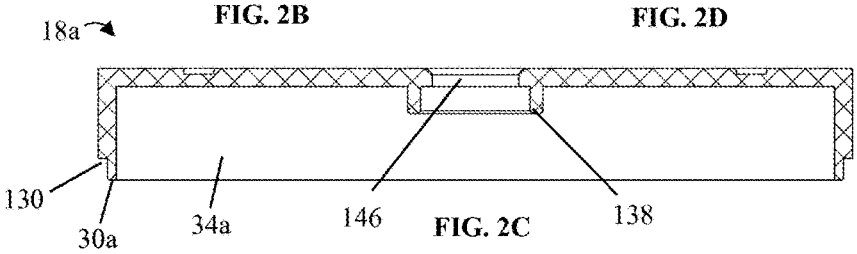
Figure 2E:
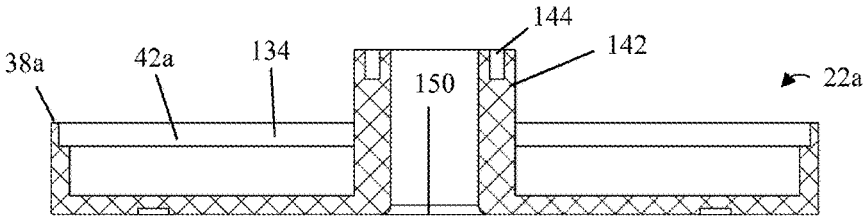
Figure 2F:
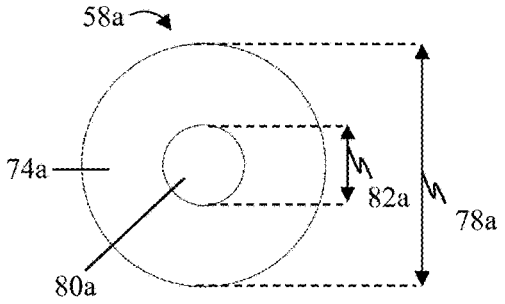
FIG. 2F is a top view of a ballast member of the puck of FIG. 2A.
Figure 2G:
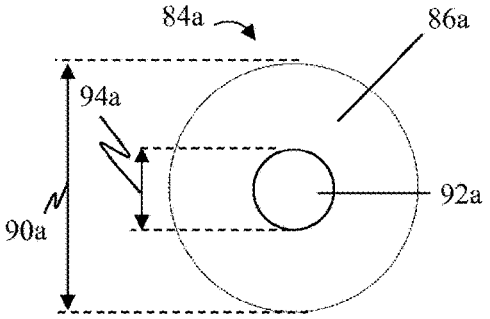
FIG. 2G is a top view of a resilient material of the puck of FIG. 2A.

In the embodiment shown, puck 10 comprises a cylindrical outer housing 98 having a substantially circular cross-section (e.g., as shown in FIG. 1I). In the embodiment shown, outer housing 98 surrounds shell 14 (e.g., shell 14 is completely disposed within outer housing 98). In this embodiment, outer housing 98 is single-piece (e.g., molded and/or otherwise constructed from a single piece of material). For example, outer housing 98 can be injection molded around shell 14. In the embodiment shown, outer housing 98 comprises an upper end 102 and a lower end 106, and each end defines a recessed portion, 110 and 114, respectively (e.g., a substantially annular recessed portion, as shown). Recessed portions 110 and/or 114 can be configured to adjust the frictional force between a given surface and the puck, for example, by reducing the surface area of the puck that contacts the surface. In the embodiment shown, outer housing 98 is configured to have dimensions similar to a conventional ice hockey puck and puck 10 is configured to have an overall weight similar to that of a conventional ice hockey puck. For example, in the embodiment shown, outer housing 98 has a transverse dimension 118 of about 3 inches (in) (e.g., between 2.7 in. and 3.3 in., between 2.8 in. and 3.2 in., or between 2.9 in. and 3.1 in.), and a height 122 of about 1 in. (e.g., between 0.8 in. and 1.2 in., or between 0.9 in. and 1.1 in.).

FIG. 2A-2G depict a second embodiment 10*a* of the present pucks. Puck 10*a* is substantially similar to puck 10, with the primary exceptions that central shaft 54*a* of shell 14*a* includes a central channel 126 through which material used to mold outer shell 98*a* can flow (and solidify) to maintain the distance between the top and bottom of puck 10*a*. In the embodiment shown, lower end 30*a* of upper shell member defines a first recessed ridge 130 and upper end 38*a* of lower shell member 22*a* defines a second recessed ridge 134 configured to receive the first recessed ridge when the upper shell member is coupled to the lower shell member (e.g., as shown). In the embodiment shown, upper shell member 18*a* comprise an annular ridge 138, and lower shell member 22*a* comprises an annular ridge 142. In this embodiment, annular ridges 138 and 142 each extend longitudinally into the recess of its respective shell member (e.g., first recess 34*a* and second recess 42*a*, respectively), and each surrounds an opening of its respective shell member (e.g., openings 146 and 150, respectively). In this embodiment, protruding ridges 138 and 142 are configured to couple together when the upper shell member is coupled to the lower shell member, for example, to define at least a portion of central shaft 54*a*. More particularly, in this embodiment, the upper end of ridge 142 includes an annular groove 144 that is configured to receive ridge 138.

In this embodiment, interior channel 126 of central shaft 54*a* is defined at least in part by openings 146 and 150, and a portion of cylindrical outer housing 98*a* is disposed within the interior channel, as shown. In this way, for example, outer housing 98*a* can provide structural support for puck 10*a*, outer housing 98*a*, shell 14*a*, upper shell member 18*a* and lower shell member 22*a*, and/or the like. In the embodiment shown, both ballast member 58*a* and resilient material 84*a* are disposed around central shaft 54*a* such that the ballast member and resilient material can translate relative to shell 14*a*. For example, in this embodiment, transverse dimension 82*a* of hole 80*a* of ballast member 58*a*, and transverse dimension 94*a* of hole 92*a* of resilient material 84*a* are each larger than transverse dimension 56*a* of central shaft 54*a*. In this way, when puck 10*a* is struck, both ballast member 58*a* and resilient material 84*a* can translate relative to central shaft 54*a* (e.g., limited by the central shaft and/or a sidewall 96*a* of cavity 26*a*). For example, once resilient material 84*a* contacts outer wall 96*a*, ballast member 58*a* can still move laterally relative to resilient material 84*a* (e.g., transverse dimension 78*a* of ballast member 58 is smaller than transverse dimension 90*a* of resilient material) and resilient material 84*a* can absorb kinetic energy of ballast member 58*a* (e.g., through deformation and/or application of friction to the ballast member).

Figure 3:
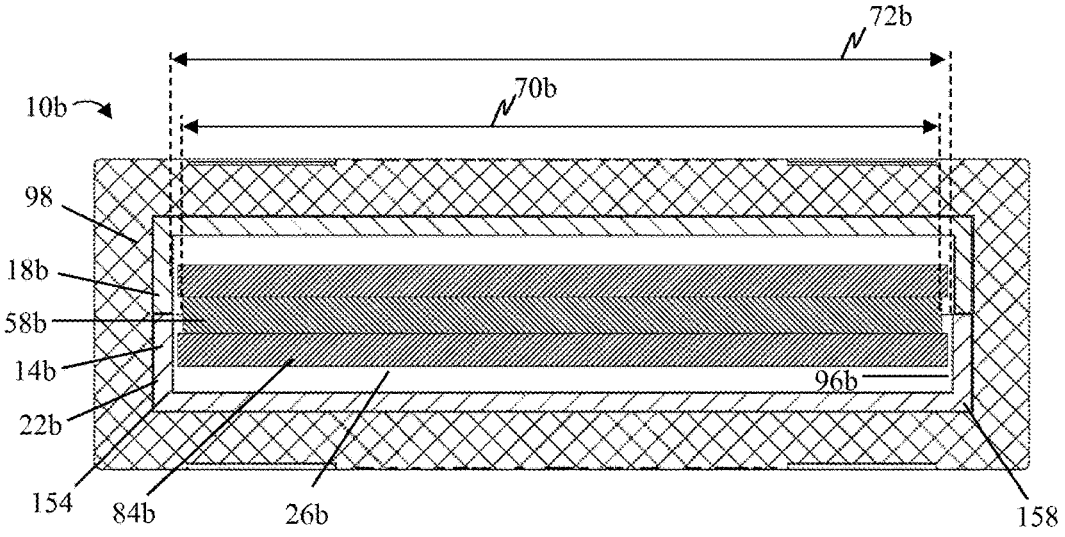
FIG. 3 is a cross-sectional side view of a third embodiment of the present pucks.

FIG. 3 depicts a third embodiment 10*b* of the present pucks. Puck 10*b* is substantially similar to puck 10, with the primary exception that puck 10*b* does not comprise a central shaft. For example, in the embodiment shown, cavity 26*b* defined by shell 14*b* extends from a first side 154 to a second side 158 of shell 14*b*, substantially uninterrupted by any features of upper shell member 18*b* or lower shell member 22*b*. In this embodiment, at least one dimension (e.g., 70*b*) of the ballast member spans a majority of a corresponding dimension (e.g., 72*b*) of the cavity. In this way, when puck 10*b* is struck, both ballast member 58*b* and resilient material 84*b* can translate relative to shell 14*b* (e.g., limited by a sidewall 96*b* of cavity 26*b*). For example, once resilient material 84*b* contacts outer wall 96*b*, the ballast member can still move laterally relative to resilient material 84*b* (e.g., through ballast member 58*b* having a smaller transverse dimension than that of resilient material 84*b*), and resilient material 84*b* can absorb kinetic energy of ballast member 58*b* (e.g., through deformation and/or application of friction to the ballast member). In other embodiments, substantially the same functionality can be achieved with the ballast member disposed in the cavity and in contact with the sidewall of the cavity.

Some embodiments of the present methods for assembling a hockey puck for use on ice and non-ice surfaces comprise disposing a ballast member (e.g., 58, 58*a*) in a cavity (e.g., 26, 26*a*) of a shell (e.g., 14, 14*a*) such that at least a portion of the ballast member is translatable relative to the shell (e.g., along a direction indicated by arrows 62, 66, and/or the like) and at least one dimension of the ballast member (e.g., 70) spans a majority of a corresponding dimension of the cavity (e.g., 72). Some methods comprise disposing a resilient material (e.g., 84, 84*a*) in the cavity such that the resilient material resists translation of the ballast member in at least one direction (e.g., a direction indicated by arrows 62, 66, and/or the like) relative to the shell. Some methods comprise disposing a single-piece cylindrical outer housing (e.g., 98, 98*a*) around the shell such that the outer housing substantially surrounds the shell. In some of the present methods, the outer housing is molded around the shell.

Figure 4A:
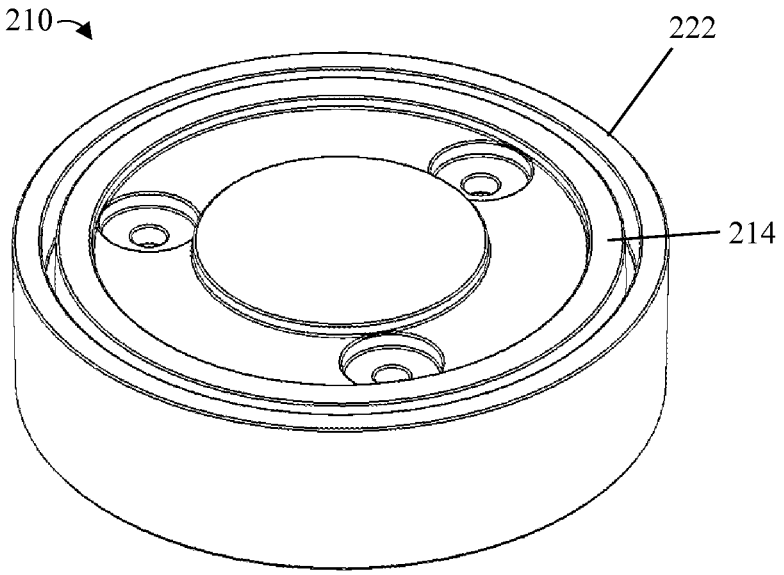
FIGS. 4A and 4B are upper perspective and top views, respectively, of a fourth embodiment of the present pucks, shown with connectors omitted.
Figure 4B:
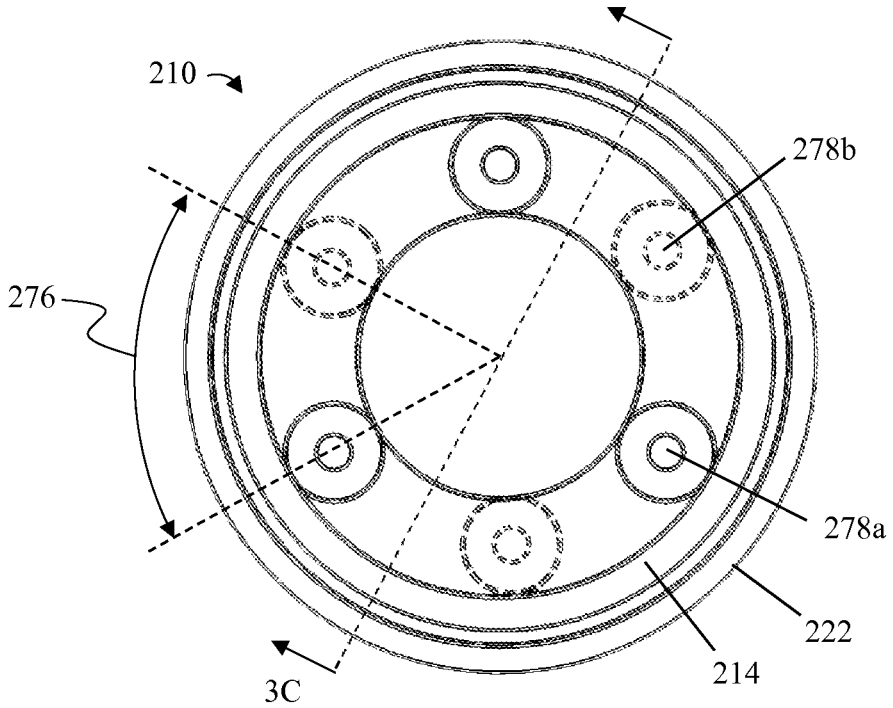
Figure 4C:
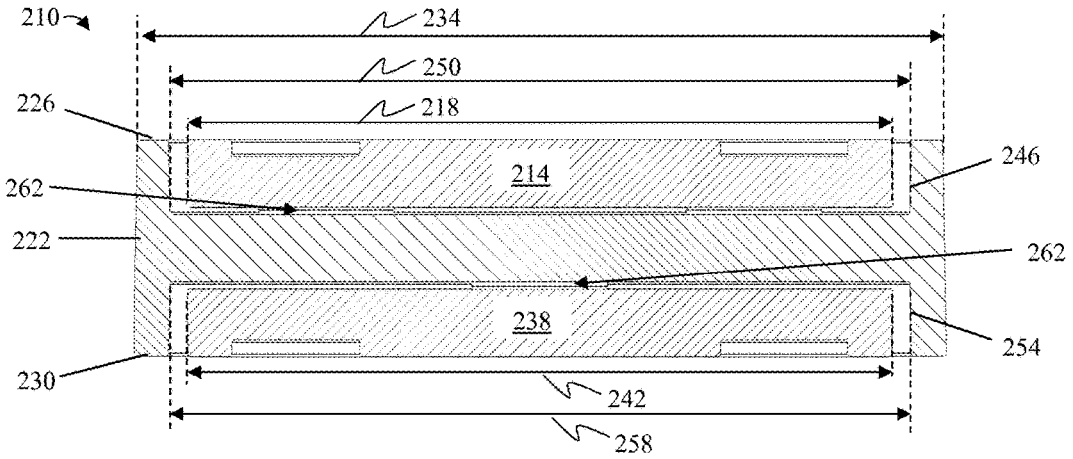
FIG. 4C is a cross-sectional side view of the puck of FIG. 4A.

Referring now to FIGS. 4A-4C, shown is a fourth embodiment 210 of the present pucks. In the embodiment shown, puck 210 comprises a first member 214 that has a substantially cylindrical outer profile (e.g., as shown) having a first diameter 218. In the embodiment shown, puck 210 further comprises a middle or second member 222 that has a first end 226, a second end 230, and at least one transverse dimension (e.g., diameter 234) that is larger than first diameter 218. As shown, puck 210 further comprises a third member 238 that has a substantially cylindrical outer profile (e.g., and that can be the same or substantially similar to that of first member 214, as described below) and has a third diameter 242 (e.g., which can be, but is not required to be, substantially equal to first diameter 218).

In the embodiment shown, puck 210 further comprises a plurality of fasteners 244 (shown and described in more detail below) configured to couple first member 214 to second member 222 (e.g., adjacent first end 226 of second member 222, as shown) independently of third member 238 such that the first member is movable within a limited range of motion relative to the second member (e.g., first member 214 is not connected to third member 238 and vice versa). For example, in the embodiment shown, second member 222 defines a first recess 246 extending inward from first end 226 and configured to receive at least a portion of first member 214 (e.g., as shown). First recess 246 can have a transverse dimension (e.g., diameter 250) that is larger than first diameter 218 of first member 214 (e.g., to permit some amount of and/or physically limit lateral movement of first member 214 relative to second member 222 within first recess 246). Similarly, in the embodiment shown, puck 210 further comprises a second plurality of fasteners 244 configured to couple third member 238 to second member 222 independently of first member 214 such that third member 238 is movable within a limited range of motion relative to the second member (e.g., the fasteners that couple third member 238 to second member 222 may be identical to, but need not the same as, the fasteners that couple first member 214 to second member 222). Such coupling and/or functionality can be accomplished in the same or a similar fashion to as described for first member 214 and second member 222 (e.g., with second end 230 of second member 222 defining a second recess 254 having a transverse dimension (e.g., diameter 258) that is larger than third diameter 242 to permit some amount of and/or physically limit lateral movement of third member 238 relative to second member 222 within second recess 254). In this embodiment, first member 214 and/or third member 238 can be permitted limited movement relative to second member 222 (e.g., physically limited, for example, by at least the dimensions of recesses 246 and/or 254 and/or limited by the configuration (e.g., stiffness and/or dimensions) of fasteners 244). In the embodiment shown, the puck is configured such that an outer end 270 (shown in FIG. 5B) of each of the first and third members protrudes past the respective end (226 or 230) of second member 222 to contact a surface on which the puck is disposed. However, in some embodiments, recesses 246 and/or 254 can be configured to completely contain the respective one of the first and third members, such as, for example, to reduce the effective surface the puck presents to a playing surface.

In the embodiment shown, puck 210 further comprises resilient material (e.g., a rubber, resilient polymer, spring, woven or matted material, and/or the like that is/are configured to absorb energy when deflected) disposed between first member 214 and second member 222 and between third member 238 and second member 222 (and described in more detail below). Such resilient materials can enhance the ability of the present pucks to absorb impacts and thus result in pucks with enhanced stability (e.g., less prone to bouncing, rolling, tumbling, and/or the like).

Figure 5A:
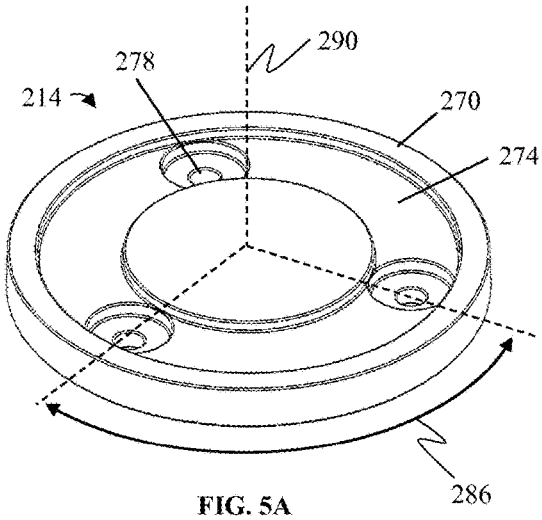
FIGS. 5A and 5B are upper perspective and top views, respectively, of the first member of the puck of FIG. 4A.
Figure 5B:
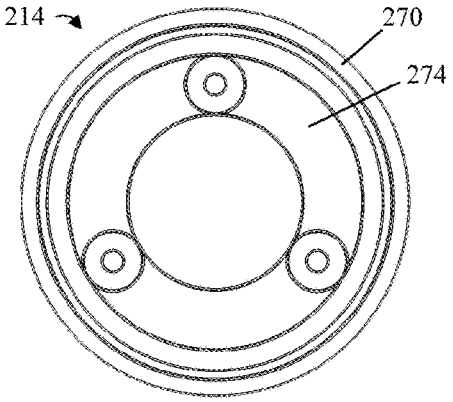

FIGS. 5A and 5B show perspective and side views, respectively, of a first member 214 suitable for use in at least some embodiments of the present pucks (e.g., puck 210). While not required in all embodiments, in the embodiment shown, first member 214 is substantially similar to third member 238 (e.g., the third member can possess any or all of the depicted and/or described features). In the embodiment shown, an outer end 270 of first member 214 (e.g., an end configured to face away from second member 222 when the first member is coupled to the second member) defines a substantially annular recess 274 (e.g., as shown) such that the recessed portion reduces (relative to a continuous planar surface) the surface area that contacts a playing surface during use, which can reduce drag forces between the puck and the playing surface (e.g., by presenting a smaller contact puck surface area to the playing surface) and thereby improving the function of the present pucks in simulating the behavior of a traditional puck on an ice surface.

In the embodiment shown, first member 214 further defines a first plurality of holes 278, each configured to receive one of a plurality of fasteners 244 (e.g., one of a first plurality of fasteners associated with first member 214). In the embodiment shown, the first plurality of holes is defined within recess 274 (e.g., which can help prevent any fasteners from interfering with (e.g., catching on) imperfections, dirt, and/or debris on a playing surface). In the embodiment shown, at least some of the first plurality of holes are counterbored, as shown, to prevent the fastener from extending beyond outer end 270 to minimize the likelihood of the fasteners interfering with a surface when the puck is in play. In the embodiment shown, the first plurality of holes comprises three holes, however, members (e.g., first and/or third members) of other embodiments of the present pucks can comprise any suitable number of holes in any suitable configuration (e.g., 1, 2, 3, 4, 5, 6, or more holes). In other embodiments, first member 214 and/or third member 238 may omit all or some of the holes and/or may be configured to be independently coupled to the second member through structures such as interlocking features (e.g., as described in more detail below with reference to FIG. 8C) and/or the like.

In the embodiment shown, holes 278 are disposed at equiangular spaces (e.g., 120 degrees as indicated by angle 286) around a central axis 290 of the respective member (e.g., each of the plurality of holes 278 of first member 214 is equiangularly spaced about central axis 290 from each adjacent hole by an equiangular space (e.g., angle 286) of about 120 degrees because there are three holes). As shown in FIG. 4B, in this embodiment, holes 278*a* of first member 214 may be angularly disposed relative to holes 278*b* of third member 238 by an angle 276 (e.g., approximately 60 degrees) when the first member is coupled to the second member and the third member is coupled to the second member.

Figure 6A:
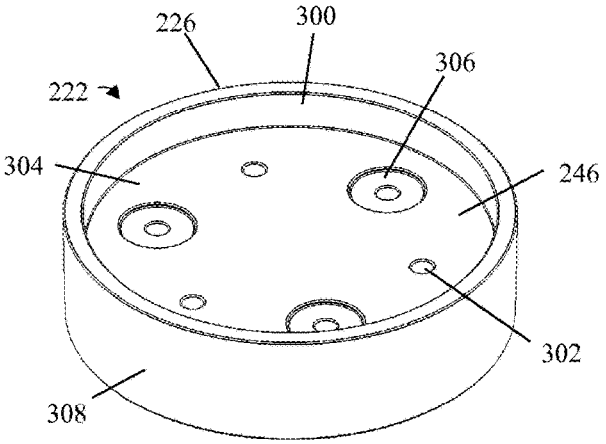
FIGS. 6A and 6B are upper perspective and top views, respectively, of the second member of the puck of FIG. 4A.
Figure 6B:
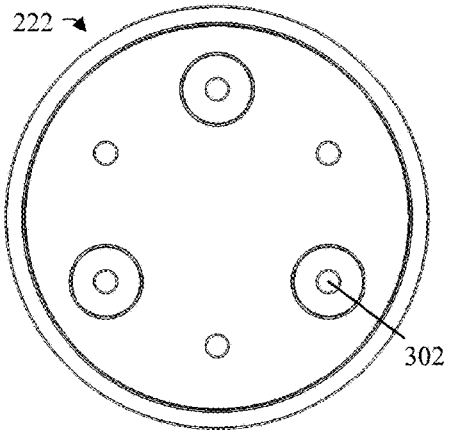

FIGS. 6A and 6B show an example of a middle or second member 222 suitable for use in at least some embodiments of the present pucks (e.g., puck 210). In the embodiment shown, first recess 246 is defined at least in part by an annular wall 300 (e.g., that terminates at and/or defines first end 226) and a substantially planar central portion 304 (e.g., that is surrounded by the annular wall). While not required, in the embodiment shown, second recess 254 is substantially symmetrical with first recess 246 (with the exception that recesses 306 of first recess 246 are rotated or angularly offset by 30 degrees relative to recesses 306 in second recess 246). In the embodiment shown, recesses 246 and 254 are configured to receive a majority of the first and third members, respectively, such that puck 210 comprises a continuous surface 308 for striking. In this embodiment, surface 308 provides a surface on which puck 210 can be struck during use, while still possessing the capability to absorb impacts and thus have enhanced stability (e.g., via the movement of first member 214 relative to second member 222, and/or movement of third member 238 relative to the second member, as tempered by resilient washers 262, fasteners 244, and/or the like, which can be mostly and even substantially internal to (e.g., surface 308 of) second member 222). In the embodiment shown, the second member defines a third plurality of holes 302, each configured to correspond with a fastener associated with either first member 214 and/or third member 238 (e.g., to allow independent coupling of the first member to the second member and the third member to the second member). In the embodiment shown, each of the third plurality of holes comprises a recess 306 (e.g., a circular recess, concentric with the hole around which it is disposed, as shown). In the embodiment shown, each of plurality of holes 302 associated with the first member has a recess 306 that faces towards the first member. Likewise, each of plurality of holes 302 associated with the third member has a recess 306 that faces towards the third member. Such recesses 306 can be configured to receive a resilient material (e.g., resilient washers 262).

Figure 7A:
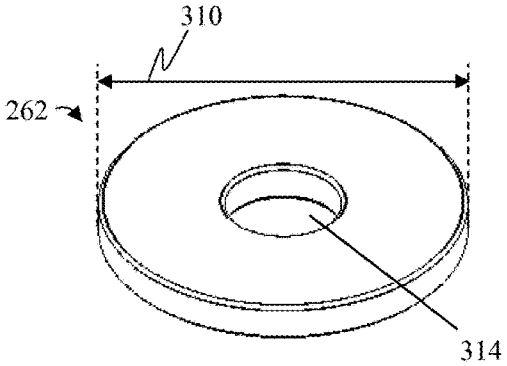
FIGS. 7A and 7B depict upper perspective and side views, respectively, of a resilient washer suitable for use in the puck of FIG. 4A.
Figure 7B:
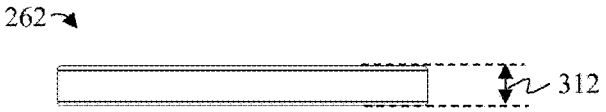

FIGS. 7A and 7B show an example of a resilient material 262 (e.g., a resilient washer) (e.g., a spacer) suitable for use in some embodiments of the present pucks (e.g., puck 210). Resilient washers 262 can comprise any suitable material, including, but not limited to, foam, rubber, resilient polymer, spring, woven or matted material, and/or the like that is/are configured to absorb energy when deflected. In the embodiment shown, resilient washers 262 are configured to partially fit within recesses 306 of second member 222 (e.g., by having a diameter 310 that corresponds with the diameter of a recess 306) and receive a fastener 244 through a hole portion 314. However, in other embodiments, recesses 306 need not be present and/or washers 262 may not be circular and/or can have any size and/or shape that permits the function described in this disclosure (e.g., a single piece of resilient material that spans holes 302 and through which multiple fasteners extend). Yet other embodiments may not comprise such resilient washers, and may instead comprise members (e.g., first, second and/or third members) and/or fasteners that are comprised of and/or include a resilient material (e.g., to perform an energy absorbing function similar to the resilient washers). Resilient materials of the present pucks can comprise any suitable thickness 312 (e.g., which can be configured to increase energy absorption effects of the resilient materials and/or serve as a spacer to set a distance between the first member and the second member and/or between the third member and the second member).

Figure 8A:
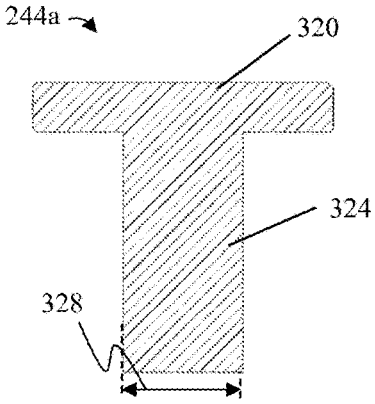
FIGS. 8A-8C are cross-sectional side views of various fasteners suitable for use in the puck of FIG. 4A.
Figure 8B:
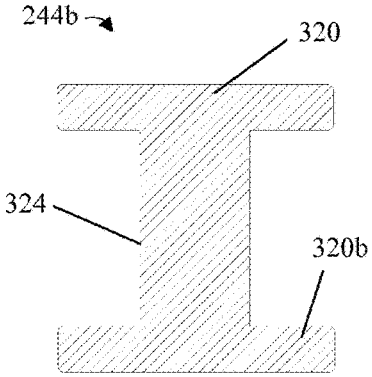
Figure 8C:
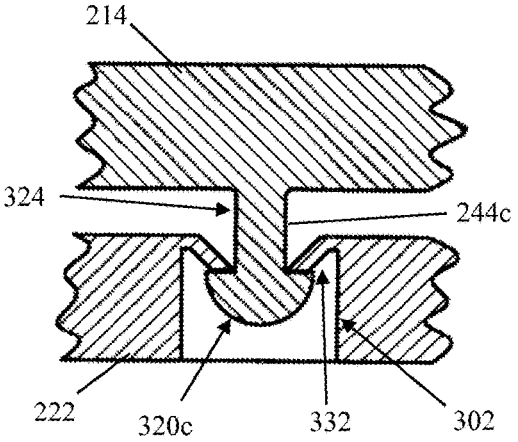

Referring now to FIGS. 8A-8C, shown are cross-sectional views of various fasteners suitable for use in some embodiments of the present pucks (e.g., puck 210). The following examples are provided for non-limiting and illustrative purposes only, and fasteners of the present pucks can comprise any suitable structure which permits the functionality described in this disclosure, including, but not limited to, rivets, threaded fasteners, interlocking features disposed on and/or amongst the first and second and/or second and third members, adhesives, and/or the like.

FIG. 8A depicts a fastener 244*a* (e.g., screw, bolt, pin, and/or the like) that comprises a head portion 320 and a shaft portion 324 (with or without threads). For example, shaft portion 324 can be configured to be received within one of holes 302 of the second member (and/or holes 278 configured to receive the shaft portion), and head portion 320 can be configured to resist passing through holes 302 such that the fastener can retain first member 214 relative to second member 222, or third member 238 relative to second member 222. For example, shaft portion 324 can be configured with transverse dimensions (e.g., diameter 328) smaller than holes 278*a* and 278*b*, and/or hole portion 314 of the resilient washer, but larger than holes 302 into which the fasteners are secured such that, the first and third members are permitted to move longitudinally and/or laterally relative to the shaft portions 324 of the respective fasteners but the fasteners (once secured) are not permitted to move relative to second member 222. In some embodiments, transverse dimension 328 can be configured to be slightly larger than the diameter of holes 302 (e.g., to provide a friction fit for non-threaded fasteners, or with male threads configured to cut into or be received in threads of second member 222). In embodiments in which shaft portion 324 is threaded such that the depth of the first and/or third member within a corresponding recess (e.g., 246 or 254) of second member 222 can be controlled (e.g., by rotating the threaded fasteners into or out of second member 222). In this way, the impact absorbing characteristics of the present pucks can be adjusted (e.g., by pressing the first or third members against second member and/or compressing any resilient materials disposed between the members).

FIG. 8B depicts fastener 244*b*, which is substantially similar to fastener 244*a*, with the primary exception that fastener 244*b* comprises a second head portion 320*b* disposed on an opposite end of shaft 324 from head 320 (e.g., the depicted fastener 244*b* can comprise a rivet after securement or expansion of its second end to form the expanded second head portion 320*b*, which before securement can have a cross-sectional shape similar to fastener 244*a* of FIG. 8A). Second head 320*b* can facilitate some degree of securement of first or third member relative to second member (e.g., such securement and function can be substantially similar to as described for head 320).

FIG. 8C depicts fastener 244*c*, which is substantially similar to fastener 244*a*, with the primary exceptions that fastener 244*c* comprises a rounded head 320*c*, and has complementary portions that are each unitary with one of the first, second, and third members member (e.g., 214, 222, or 238). In embodiments of the present pucks comprising fastener 244*c*, not all members (e.g., 214, 222, or 238) need comprise holes. For example, in the embodiment shown, first member 214 is unitary with fastener 244*c*, and only member 222 need comprise a hole (e.g., 302). Additionally, in these and similar embodiments, such holes (e.g., 302) can comprise tabs or other interlocking features 332, for example, configured to expand to receive head 320*c* upon insertion, and contract towards shaft 324 after insertion to help prevent head 320*c* from being withdrawn from hole 302. In other embodiments, fasteners 244*c* can be unitary with second member 222 and each can be configured to be received within a hole of first member 214 (e.g., 278*a*) or a hole of third member 238 (e.g., 278*b*) (e.g., in a substantially similar fashion). While not shown in FIGS. 8A-8B, resilient materials such as washers 262 can be included with any of the depicted fasteners (e.g., whether each disposed around a shaft 324 or otherwise, as described above).

Some of the present methods comprise coupling, with a first plurality of fasteners (e.g., 244*a*, 244*b*, 244*c*, and/or the like), a first member (e.g., 214) to a first end (e.g., 226) of a second member (e.g., 222) such that the first member is movable within a limited range of motion relative to the second member, the first member being substantially cylindrical and having a first diameter (e.g., 218), the second member having at least one transverse dimension that is larger than the first diameter (e.g., 234), and coupling, with a second plurality of fasteners (e.g., 244*a*, 244*b*, 244*c*, and/or the like), a third member (e.g., 238) to a second end (e.g., 230) of the second member such that the third member is movable within a limited range of motion relative to the second member, the third member being substantially cylindrical and having a third diameter (e.g., 242). Some of the present methods comprise disposing resilient material (e.g., 262) between the first cylindrical member and the third member. Some of the present methods comprise disposing resilient material between the second cylindrical member and the third member.

In some embodiments, the present pucks (e.g., 10, 10*a*, 10*b*, 210) have a weight of between 4.5 ounces (oz.) and 6 oz. (e.g., between 5 oz. and 5.5 oz.); and, in embodiments with a ballast member, the ballast member (e.g., 58, 58*a*, 58*b*) can have a weight of between 40% and 60% of the overall weight of the puck (e.g., between 45% and 55% of the overall weight of the puck, or between 2.25 oz. and 3 oz.). This overall weight range is similar to that of a conventional ice hockey puck.

In other embodiments, the present pucks (e.g., 10, 10*a*, 10*b*, 210) have a weight (e.g., between 2.5 ounces and 4 ounces) that is less than the weight of a conventional hockey puck (e.g., between 5.5 oz. and 6 oz.); and, in embodiments with a ballast member, the ballast member (e.g., 58, 58*a*, 58*b*) can have a weight of between 15% and 25% of the overall weight of the puck. The lower weight (relative to a conventional hockey puck) permits a user to perform speed and/or stickhandling exercises off-ice.

In other embodiments, the present pucks (e.g., 10, 10*a*, 10*b*, 210) have a weight (e.g., between 8 oz. and 10 oz., or between 8.5 oz. and 9.5 oz.) that is greater than the weight of a conventional hockey puck (e.g., between 5.5 oz. 6 oz.); and, in embodiments with a ballast member, the ballast member (e.g., 58, 58*a*, 58*b*) can have a weight of between 60% and 80% of the overall weight of the puck. The greater weight permits a user to perform strength exercises off-ice in which the contact point of the ball is similar to a hockey puck but the additional weight can add resistance to improve the user's strength. The weight of the puck can be varied by changing the size of the puck, the materials of the puck (although many polymers have about the same density), and/or the parts of the puck (e.g., the ballast member).

In embodiments of the present pucks, various components (e.g., shell 14, 14*a*, 14*b* and/or outer shell 98, 98*a* of pucks 10, 10*a*, 10*b*; and first member 214, second member 222, and/or third member 238 of puck 210) can comprise non-metallic materials such as, for example, polymers, nylon, and/or composite materials that can be molded and that have suitable impact-resistant characteristics (e.g., that will resist cracking and permanent deformation during and/or due to repeated impact with a hockey stick). Examples of materials that are suitable for at least some embodiments include: (1) nylon reinforced with glass fibers (e.g., 30% glass fibers) and including polytetrafluoroethylene (PTFE) (e.g., 15% PTFE), which may be known or offered for sale as "RTP 205

H TFE 15"; (2) polyoxymethylene (POM), which may be known or offered for sale as DELRIN; and (3) fiber reinforced polyester (FRP).

The above specification and examples provide a complete description of the structure and use of illustrative embodiments. Although certain embodiments have been described above with a certain degree of particularity, or with reference to one or more individual embodiments, those skilled in the art could make numerous alterations to the disclosed embodiments without departing from the scope of this invention. As such, the various illustrative embodiments of the methods and systems are not intended to be limited to the particular forms disclosed. Rather, they include all modifications and alternatives falling within the scope of the claims, and embodiments other than the one shown may include some or all of the features of the depicted embodiment. For example, elements may be omitted or combined as a unitary structure, and/or connections may be substituted. Further, where appropriate, aspects of any of the examples described above may be combined with aspects of any of the other examples described to form further examples having comparable or different properties and/or functions, and addressing the same or different problems. Similarly, it will be understood that the benefits and advantages described above may relate to one embodiment or may relate to several embodiments.

The claims are not intended to include, and should not be interpreted to include, means-plus- or step-plus-function limitations, unless such a limitation is explicitly recited in a given claim using the phrase(s) "means for" or "step for," respectively.

The invention claimed is:

1. A hockey puck for use on ice and non-ice surfaces comprising: a shell comprising an upper shell member and a lower shell member coupled to the upper shell member to define a central shaft and a cavity, the cavity being enclosed by the shell and surrounding the central shaft; a ballast member disposed in the cavity and around the central shaft such that the central shaft extends through the ballast member and at least a portion of the ballast member is translatable relative to the shell; and a resilient material disposed in the cavity and configured to resist translation of the ballast member in at least one direction relative to the shell, wherein a longitudinal axis that is equidistant from a perimeter of the shell extends through a center point of the central shaft and the shell.

2. The hockey puck of claim 1, where the resilient material is disposed around the central shaft such that the central shaft extends through the resilient material.

3. The hockey puck of claim 1, further comprising a cylindrical outer housing surrounding the shell, the outer housing having a substantially circular cross-section.

4. The hockey puck of claim 1, where the upper shell member is not coupled to the lower shell member by a fastener.

5. The hockey puck of claim 1, where the ballast member comprises a plate.

6. The hockey puck of claim 1, where the resilient material is disposed on at least two sides of the ballast member.

7. The hockey puck of claim 1, where the hockey puck has a weight of between 4.5 ounces (oz.) and 6 oz.

8. The hockey puck of claim 7, where the ballast has a weight of between 40% and 60% of the weight of the hockey puck.

9. The hockey puck of claim 1, where the hockey puck has a weight of between 2.5 ounces (oz.) and 4 oz.

10. The hockey puck of claim 9, where the ballast has a weight of between 15% and 25% of the weight of the hockey puck.

11. The hockey puck of claim 1, where the hockey puck has a weight of between 8 ounces (oz.) and 10 oz.

12. The hockey puck of claim 11, where the ballast has a weight of between 60% and 80% of the weight of the hockey puck.

13. A hockey puck for use on ice and non-ice surfaces comprising: a shell comprising an upper shell member and a lower shell member coupled to the upper shell member to define a central shaft and a cavity enclosed by the shell and surrounding the central shaft; a ballast member disposed in the cavity such that at least a portion of the ballast member is translatable relative to the shell, at least one dimension of the ballast member spanning a majority of a corresponding dimension of the cavity; and a resilient material disposed in the cavity and configured to resist translation of the ballast member in at least one direction relative to the shell; wherein the central shaft and the shell are each cylindrical and have a center point that lies on the same longitudinal axis.

14. The hockey puck of claim 13, further comprising a cylindrical outer housing surrounding the shell, the outer housing having a substantially circular cross-section.

15. The hockey puck of claim 13, where the upper shell member is not coupled to the lower shell member by a fastener.

16. The hockey puck of claim 13, where the resilient material is disposed on at least two sides of the ballast member.

17. A hockey puck for use on ice and non-ice surfaces comprising:

a shell comprising an upper shell member and a lower shell member coupled to the upper shell member to define a central shaft and a cavity, a portion of the central shaft being equidistant from an outer perimeter of the shell;

a ballast member disposed within the cavity and surrounding the central shaft such that at least a portion of the ballast member is translatable relative to the shell; and a single-piece, cylindrical outer housing substantially surrounding the shell, the outer housing having a substantially circular cross-section.

18. The hockey puck of claim 17, further comprising a resilient material disposed in the cavity and configured to resist translation of the ballast member in at least one direction relative to the shell.

19. The hockey puck of claim 17, where the upper shell member is not coupled to the lower shell member by a fastener.

20. The hockey puck of claim 17, where the resilient material is disposed on at least two sides of the ballast member.

* * * * *